US009622552B2

(12) United States Patent
Pemberton

(10) Patent No.: US 9,622,552 B2
(45) Date of Patent: Apr. 18, 2017

(54) DEVICE FOR CARRYING CORDAGE AND SURVIVAL TOOLS AND METHOD FOR MANUFACTURING THE SAME

(71) Applicant: Webbem Limited, Hong Kong (HK)

(72) Inventor: Brian Pemberton, Hong Kong (HK)

(73) Assignee: Webbem Limited, Hong Kong (HK)

( * ) Notice: Subject to any disclaimer, the term of this patent is extended or adjusted under 35 U.S.C. 154(b) by 0 days.

(21) Appl. No.: 15/044,127

(22) Filed: Feb. 16, 2016

(65) Prior Publication Data

US 2016/0235168 A1 Aug. 18, 2016

Related U.S. Application Data

(60) Provisional application No. 62/116,922, filed on Feb. 17, 2015, provisional application No. 62/154,721, filed on Apr. 30, 2015.

(51) Int. Cl.

| | |
|---|---|
| ***A44C 5/00*** | (2006.01) |
| ***A45F 5/00*** | (2006.01) |
| ***B65H 54/10*** | (2006.01) |
| ***A44C 5/14*** | (2006.01) |
| ***A44C 27/00*** | (2006.01) |
| ***B26B 11/00*** | (2006.01) |
| ***B26B 9/00*** | (2006.01) |
| ***A45C 11/00*** | (2006.01) |
| ***A45C 13/30*** | (2006.01) |

(Continued)

(52) U.S. Cl.

CPC ..... *A44C 5/003* (2013.01); *A44C 5/0007* (2013.01); *A44C 5/142* (2013.01); *A44C 27/00* (2013.01); *A45C 11/00* (2013.01); *A45C 13/30* (2013.01); *A45F 3/06* (2013.01); *B26B 9/00* (2013.01); *B26B 11/00* (2013.01); *B65H 54/10* (2013.01); *A45D 8/36* (2013.01); *A45F 2005/008* (2013.01); *A45F 2200/0575* (2013.01); *A45F 2200/0591* (2013.01)

(58) Field of Classification Search

CPC ..... A45F 5/00; A45F 2005/008; A44C 5/00; A44C 5/0007; A44C 5/003

USPC ..... 224/165

See application file for complete search history.

(56) References Cited

U.S. PATENT DOCUMENTS 3,133,683 A 5/1964 Deacon, Sr.
4,177,522 A * 12/1979 Auburn ..... A41F 9/002 2/338

(Continued)

FOREIGN PATENT DOCUMENTS

EP 1142812 A1 10/2001

OTHER PUBLICATIONS

International Search Report of PCT Patent Application No. PCT/CN2016/073893 issued on May 11, 2016.

(Continued)

*Primary Examiner* — Justin Larson

(57) ABSTRACT

A device for carrying cordage and survival tools including a flexible and elongate inner core, a cord wound around the inner core, and an outer sheath provided with an open end through which the inner core with the cord wound therearound is inserted. The outer sheath with the inner core and cord inside can be used as a watch strap for carrying thereon a watch case and a box disposed underneath the watch case for carrying survival tools. A method for manufacturing the device for carrying cordage and survival tools is also disclosed.

20 Claims, 14 Drawing Sheets

(51) Int. Cl.
*A45F 3/06* (2006.01)
*A45D 8/36* (2006.01)

(56) References Cited

U.S. PATENT DOCUMENTS 5,341,972 A * 8/1994 Jacks ..... A45C 1/04 224/165
7,447,118 B1 * 11/2008 Matos ..... G04B 37/0033 368/10
D721,607 S * 1/2015 Lindstrom ..... D11/3
8,925,348 B2 * 1/2015 Gagne ..... A44C 5/0007 63/1.12
9,021,664 B2 * 5/2015 Ingalls ..... F16G 11/00 24/115 R
9,084,455 B2 * 7/2015 Millan ..... B26B 9/00
9,304,496 B1 * 4/2016 Hancock ..... B25F 1/04
9,380,842 B1 * 7/2016 Bigelow ..... A44C 5/24
2008/0178977 A1 * 7/2008 Nauman ..... A44C 5/003 150/144
2013/0031935 A1 * 2/2013 Kelleghan ..... A44C 5/00 63/1.12
2013/0213089 A1 * 8/2013 Gagne ..... A44C 5/0007 63/1.12
2014/0026371 A1 * 1/2014 Ingalls ..... F16G 11/00 24/115 R
2014/0109615 A1 * 4/2014 Millan ..... B26B 9/00 63/1.12
2015/0128643 A1 * 5/2015 King ..... D04C 1/12 63/1.12
2015/0282571 A1 * 10/2015 Gendron ..... A44C 5/0007 206/372
2016/0235168 A1 * 8/2016 Pemberton ..... A44C 5/003

OTHER PUBLICATIONS

European Search Report of counterpart European Patent Application No. 16156017.2 issued on Jul. 21, 2016.

* cited by examiner

DEVICE FOR CARRYING CORDAGE AND SURVIVAL TOOLS AND METHOD FOR MANUFACTURING THE SAME

CROSS-REFERENCE TO RELATED APPLICATIONS

This application claims the benefit of U.S. Provisional Patent Application No. 62/116,922, filed Feb. 17, 2015 and U.S. Provisional Patent Application No. 62/154,721 filed Apr. 30, 2015, the entire contents of all of which are hereby incorporated by reference.

FIELD OF THE TECHNOLOGY

The present application relates to a device for carrying cordage and survival tools, and a method for manufacturing the same.

BACKGROUND

Currently, it is known to weave high-strength, durable cord, such as paracord, into bracelets, belts, necklaces and other articles. The paracord is woven in such a way that an individual wearing the paracord can unweave the cordage in a relatively easy manner and utilize the paracord in an emergency situation. Paracord bracelets, belts and watch straps have become popular with those interested in outdoors and survival.

A paracord watch strap or bracelet usually holds around 10 feet of paracord. The paracord is made of inner yarns which can be easily separated. Thus, a 10-feet paracord can offer seven times that length of cord as well as the sheath, that is, when tied together, 80+ feet of usable cordage. This versatility is the appeal of paracord when used in bracelets, straps and belts. It is also known that items can be hidden inside the weave of the paracord. Items such as small blades, surgical tubing, fishing line, fish hooks, tinder, fire lighter to name but a few.

However, there are drawbacks and limitations with these existing paracord bracelets, straps and belts. Hence, there is a need to produce an improved device for carrying cordage and survival tools.

SUMMARY

According to one aspect, there is provided a device for carrying cordage and survival tools which may include:

- a flexible and elongate inner core having two opposite longitudinal sides and two opposite ends;
- a cord wound around the inner core;
- an outer sheath including top and bottom sheath layers attached together along their edges, and an opening provided at one end of the outer sheath through which the inner core with the cord wound therearound is inserted, the outer sheath having a length sufficient to form into a watch strap for carrying thereon a watch case and a box held underneath the watch case; and
- a strip attached on one side of the sheath at a central portion thereof by four longitudinally spaced apart and transversely extending stitches, thereby forming a central loop defining a transverse bore dimensioned to accommodate therein the box, and two additional loops defining two additional transverse bores disposed at two opposite closed ends of the central loop and dimensioned to accommodate therein two bars on which two opposite lug portions of the watch case are mounted respectively;
- wherein the box may carry items selected from the group consisting of a compass needle, a compass pivot pin, a knife blade, a knife blade holder, a fishing hook, a fishing line weight, a fire-starting Ferro cerium rod, a mirror, a water purification tablet, a medicine, a drug, a condom and a water container.

According to another aspect, there is provided a device for carrying cordage and survival tools which may include:

- a flexible and elongate inner core having two opposite longitudinal sides and two opposite ends;
- a cord wound around the inner core; and
- an outer sheath comprising top and bottom sheath layers attached together along their edges, and an opening provided at one end of the outer sheath through which the inner core with the cord wound therearound is inserted.

In one embodiment, the two opposite ends of the inner core can be enlarged ends, and the cord may be wound around the two opposite longitudinal sides along a longitudinal direction between the two enlarged ends.

In one embodiment, the two opposite ends of the inner core may be formed with two opposite rectangular notches respectively, and the cord may be wound around the two opposite rectangular notches along a transverse direction.

In one embodiment, a plurality of cords may be wound around the inner core, wherein the plurality of cords may have different sizes and weights.

In one embodiment, the cord may be wound around the inner core in a first direction, and then wound around itself in a second direction, thereby forming a rope-like structure after the inner core is removed. The rope-like structure may be inserted into a tube. The tube may be heat-shrinkable.

In one embodiment, the outer sheath may have a length sufficient to form into a watch strap for carrying thereon a watch case, and a box held underneath the watch case.

In one embodiment, the device may further include a strip attached on one side of the sheath at a central portion thereof by four longitudinally spaced apart and transversely extending stitches, thereby forming a central loop defining a transverse bore dimensioned to accommodate therein the box, and two additional loops defining two additional transverse bores disposed at two opposite closed ends of the central loop and dimensioned to accommodate therein two bars on which two opposite lug portions of the watch case are mounted respectively.

In one embodiment, the device may further include two longitudinally spaced apart transverse tubes attached on one side of the sheath at a central portion thereof, and dimensioned to accommodate therein two bars on which two opposite lug portions of the watch case are mounted respectively; wherein the two plastic tubes are respectively provided with two oppositely facing transverse sidewalls formed with transversely extending and oppositely facing projections and recesses slidably engageable with complementary projections and recesses formed on two opposite sides of the box.

In one embodiment, the watch case may be formed with a bottom recess for receiving therein the box.

In one embodiment, the watch case may be formed with a transverse bottom channel having two oppositely facing transverse sidewalls formed with transversely extending and oppositely facing projections and recesses slidably engageable with complementary projections and recesses formed on two opposite sides of the box.

In one embodiment, the watch case may be formed with a longitudinal bottom channel having two oppositely facing longitudinal sidewalls formed with longitudinally extending and oppositely facing projections and recess slidably engageable with complementary projections and recesses formed on two opposite sides of the box.

In one embodiment, the box may carry items selected from the group consisting of a compass needle, a compass pivot pin, a knife blade, a knife blade holder, a fishing hook, a fishing line weight, a fire-starting Ferro cerium rod, a mirror, a water purification tablet, a medicine, a drug, a condom and a water carrying device.

In one embodiment, the inner core may be made of plastic, and one end of the inner core can be molded into a whistle.

In one embodiment, the inner core may be a multifold waterproof paper that, when unraveled, provides survival instructions.

In one embodiment, the inner core may be a folded blanket.

In one embodiment, the inner core may be made of a material selected from the group consisting of plastic sheet, aluminum foil, and waterproof paper.

In one embodiment, the box may carry a modular knife including a knife blade and a knife blade holder, the knife blade being adapted to be held in the knife blade holder at one end thereof, and another end of the knife blade holder being provided with a spike for insertion into an end of a stick which serves as a handle.

In one embodiment, the box may carry a modular compass including a compass needle and a compass pivot pin. The pivot pin is capable of being mounted on or pierced through a bottom wall of the box, and extending inwardly from an inner surface of the bottom wall of the box, and terminating in a sharp end. The compass needle is capable of being placed on top of the sharp end of the pivot pin to form a compass.

According to a further aspect, there is provided a method for manufacturing a device for carrying cordage and survival tools. The method may include:

providing a flexible and elongate inner core having two opposite longitudinal sides and two opposite ends;

holding the two opposite ends of the inner core on a jig, and pulling the two opposite ends of the inner core longitudinally in opposite directions such that the inner core becomes taut and rigid; and winding a cord around the inner core.

In one embodiment, the jig may include:

a base;

two spaced apart vertical posts extending upwards from the base;

two rods supported horizontally at an upper portion of the two vertical posts respectively, wherein two inner ends of the two rods may be formed with two hooks for hooking to the two opposite ends of the inner core through two holes formed thereon respectively, whereby the two hooks apply a pulling force on the two opposite ends of the inner core, two outer ends of the two rods being provided with two sets of upper gears respectively;

a feeder threadably coupled with a screw thread, wherein two opposite ends of the screw thread may be supported at a lower portion of the two vertical posts respectively such that the screw thread can be disposed horizontally and parallel to the inner core, and the cord may be fed from a spool and passed through an aperture of the feeder, two outer ends of the screw thread being provided with two sets of lower gears, which are meshed with the two sets of upper gears respectively; and a motor for driving the screw thread to rotate, whereby when the screw thread rotates, the inner core spins simultaneously, and the feeder moves along the screw thread, thereby winding the cord around the inner core.

Although the device for carrying cordage and survival tools is shown and described with respect to certain embodiments, it is obvious that equivalents and modifications will occur to others skilled in the art upon the reading and understanding of the specification. The device for carrying cordage and survival tools in the present application includes all such equivalents and modifications, and is limited only by the scope of the claims.

BRIEF DESCRIPTION OF THE DRAWINGS

Specific embodiments of the device for carrying cordage and survival tools will now be described by way of example with reference to the accompanying drawings wherein.

DETAILED DESCRIPTION

Reference will now be made in detail to a preferred embodiment of the device for carrying cordage and survival tools, examples of which are also provided in the following description. Exemplary embodiments of the device for carrying cordage and survival tools are described in detail, although it will be apparent to those skilled in the relevant art that some features that are not particularly important to an understanding of the device for carrying cordage and survival tools may not be shown for the sake of clarity.

Furthermore, it should be understood that the device for carrying cordage and survival tools is not limited to the precise embodiments described below and that various changes and modifications thereof may be effected by one skilled in the art without departing from the scope of the protection. For example, elements and/or features of different illustrative embodiments may be combined with each other and/or substituted for each other within the scope of this disclosure and appended claims.

Figure 1:
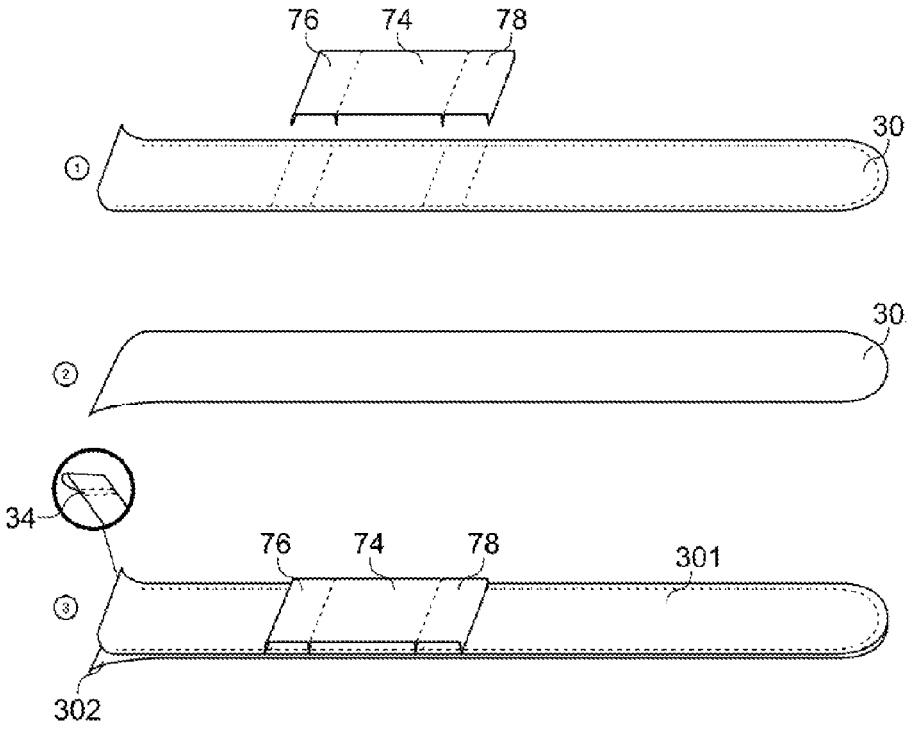
FIG. 1 shows the top sheath layer, series of stitched loops, bottom sheath layer, stitching for buckle and final construction of a device for carrying cordage and survival tools according to an embodiment of the present application.
Figure 2A:
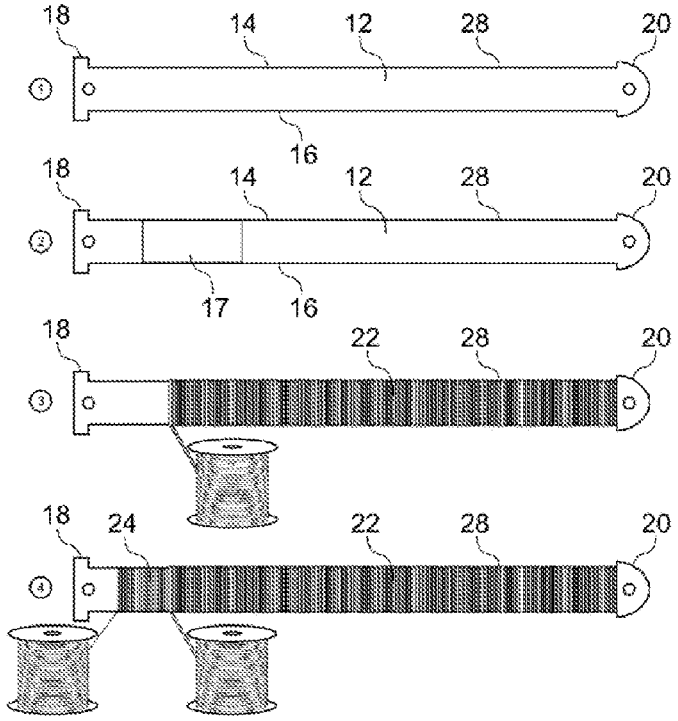
FIG. 2A shows inner cores wrapped with cordage according to some embodiments of the present application.
Figure 2B:
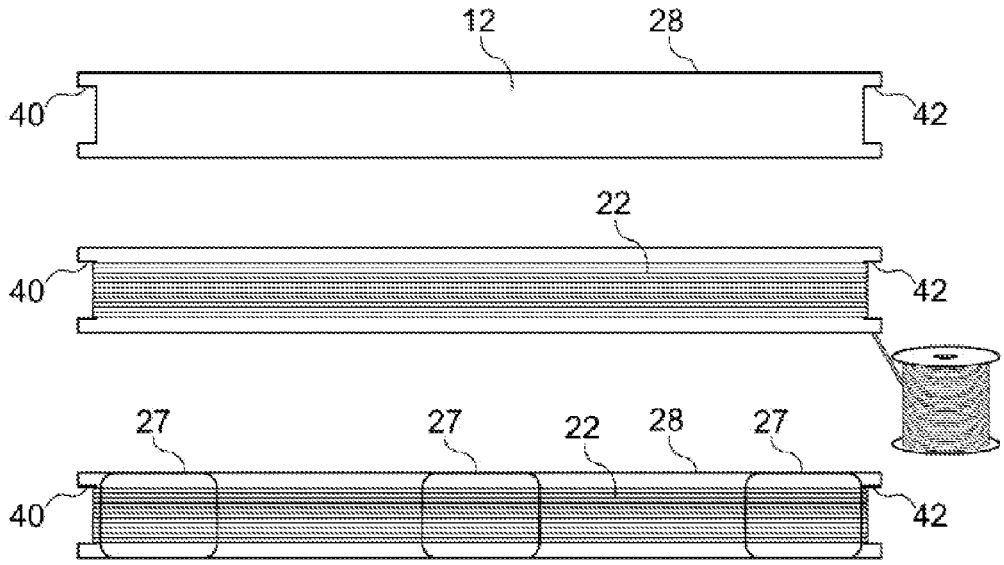
FIG. 2B shows an alternative embodiment for wrapping the cord around an inner core.

FIGS. 1, 2A and 2B show a device 10 for carrying cordage and survival tools according to some embodiments of the present application. The device 10 for carrying cordage and survival tools may include an inner core 12, a cord 22 wound around the inner core 12, and an outer sheath 30 having an opening 32 through which the inner core 12 with the wound cord 22 can be inserted. The inner core 12 may be in the form of a flexible and elongate inner core having two opposite longitudinal sides 14, 16 and two opposite ends 18, 20. The outer sheath 30 may include top and bottom sheath layers 301, 302 attached together along their edges, except for an open end where the opening 32 is formed. The top and bottom sheath layers 301, 302 may be attached together by stitching or any other suitable means. The open end may be formed into a loop 34 for securing thereon a buckle after the inner core 12 with the cord 22 wound therearound is inserted into the sheath 30. A series of loops 74, 76, 78 may be provided on the top sheath layer 301 of the outer sheath 30. Details of these loops 74, 76, 78 will be described later.

FIG. 2A shows one embodiment of the inner core 12. According to this embodiment, the two opposite ends 18, 20 of the inner core 12 may be formed with two enlarged ends respectively. The cord 22 can be wound around the two opposite longitudinal sides 14, 16 of the inner core 12 along a longitudinal direction between the two opposite enlarged ends 18, 20. The inner core 12 may have a width of about 10 mm. A flat packet 17 may be attached on a surface of the inner core 12. The packet 17 may contain therein fishing hooks, shot and other items. The packet 17 may have a width of about 10 mm and a length of about 40 mm.

FIG. 2B shows another embodiment of the inner core 12. According to this embodiment, the two opposite ends 18, 20 of the inner core 12 may be formed with two opposite rectangular notches 40, 42 respectively. The cord 22 can be wound around the two opposite rectangular notches 40, 42 of the two opposite ends 18, 20 of the inner core 12 along a transverse direction. A plurality of tapes 27 may be used to hold the cord 22 in position.

The inner core 12 may be formed on a frame or an insert 28 which is insertable into the outer sheath 30 through the opening 32. The frame or insert 28 may take another form, but the principle of wrapping cord around a core to give it structure and enough rigidity to be inserted and removed from an enclosed space remains the same.

Regular cord, when inserted into a confined space, bunches up and gathers together—making it impossible to insert a great quantity of regular cord into the confined space. This is because cord and rope etc. are flexible. According to the illustrated embodiments of the present application, the cord 22 can be wrapped around the inner core 12 in such a way as to hold the cord 22 in place neatly in an organized manner while adding rigidity to the structure. Due to the rigidity, it is then possible to insert, remove and reinsert the cord 22 into a space in a way which would ordinarily be impossible. The cord 22 can be protected by the outer sheath 30.

Figure 3:
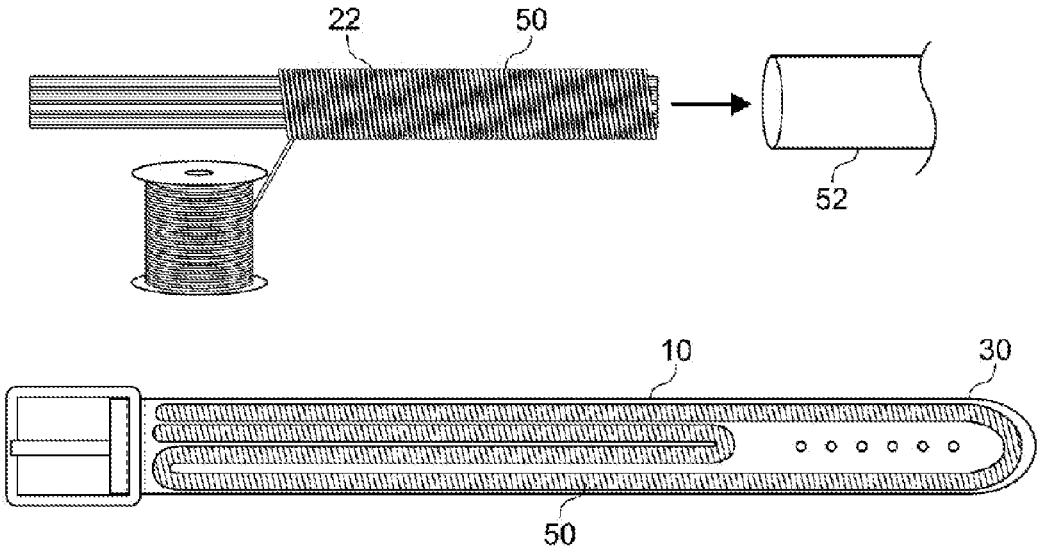
FIG. 3 shows how cordage is wrapped and attached to the inner core according to an embodiment of the present application.

FIG. 3 shows another embodiment of winding of core around the inner core 12. According to the illustrated embodiment, the cord 22 may be wound around the inner core 12 in one direction, and then wound around itself in another direction, thereby forming a rope-like structure 50 after the inner core 12 is removed. The rope-like structure 50 can be inserted into a tube 52, which may be a heat-shrinkable tube. The rope-like structure 50 may then be inserted into the outer sheath 30 to form into a strap/belt device 10.

In this embodiment, the cord 22 can be wound in such a way to offer a means for storing a great length of cord in an easy manner. The cord 22 may be wound in one direction to a length required for its application, and then wound around itself along the length required to create the thin rope-like structure 50. The rope-like structure 50 can be used as is, or it can be inserted into the tube 52. This tube 52 may have heat-shrinking qualities, so that when it is heated, it reduces in diameter and squeezes the cord 22 into a neat and workable condition. Alternatively, the tube 52 may be of a surgical tubing nature, which once removed can offer assistance as a straw, or used to help to make a catapult or sling shot. The rope-like structure 50 and the tube 52 with wound cord inside can be stitched onto the device 10 in a manner such that the ends of the cord 22 can be pulled out and the entire length can be removed from the body of the device 10. Although the cordage cannot be re-inserted into the device 10, it offers a benefit of being able to be used with a traditional watch strap or a belt with a buckle-and-hole structure.

Figure 4A:
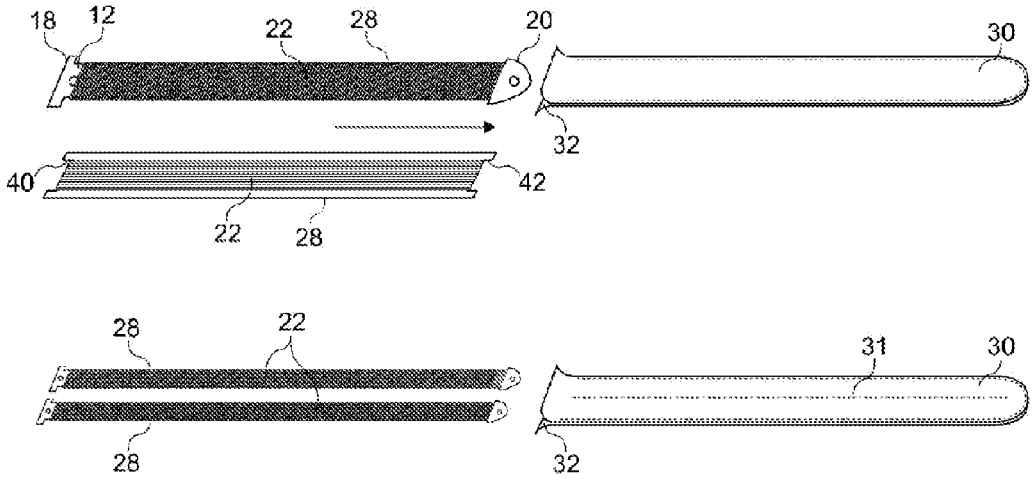
FIG. 4A shows how one or more inner cores slide into a sheath of the device according to some embodiments of the present application.
Figure 4B:
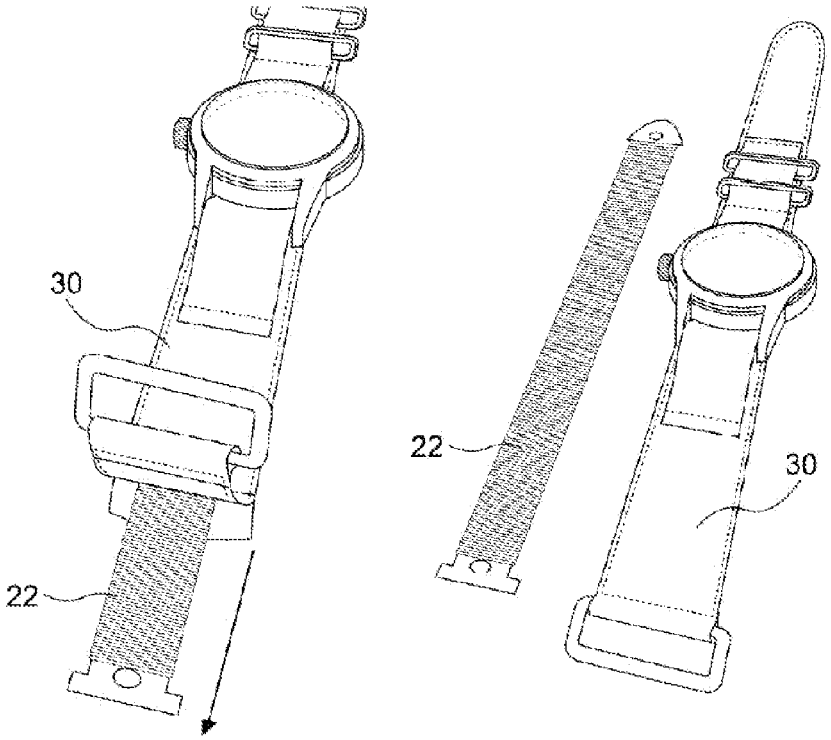
FIG. 4B shows a watch strap and how the cord can be stored in the strap according to an embodiment of the present application.
Figure 10:
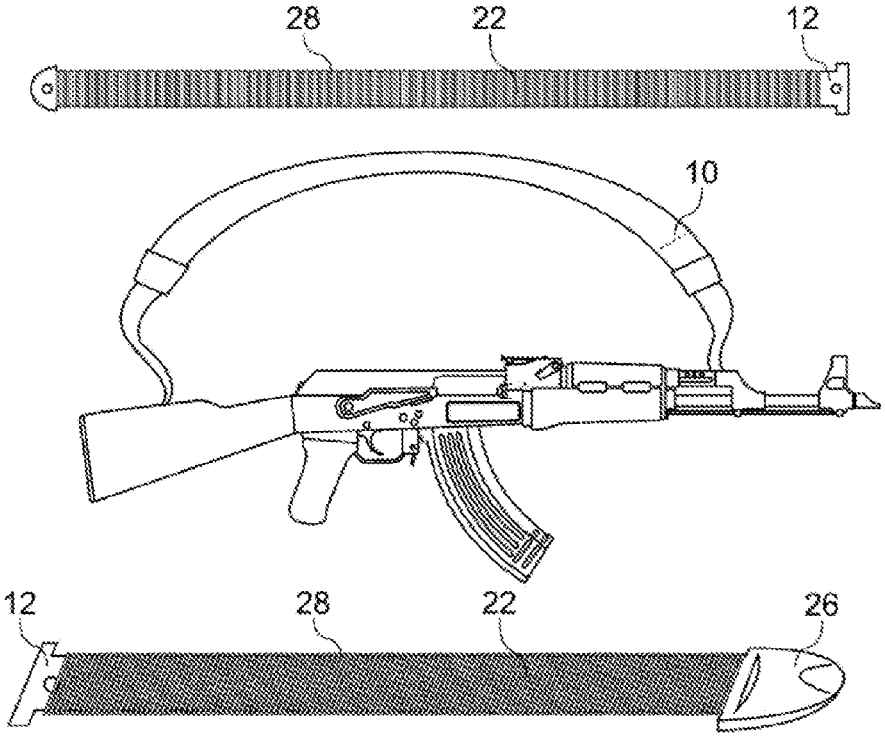
FIG. 10 shows how one embodiment may be used in a gun strap or sling, and how one end of the insert or frame may be molded to form a whistle.

Referring to FIGS. 4A and 4B, the inner core 12 can slide freely into and out of the sheath 30 of the device 10 through the opening 32. In an emergency situation, this inner core 12 can be removed from the strap/belt device 10 in a matter of seconds. This sheath 30 is not limited to a strap or belt. The sheath 30 can be in the form of a pocket or compartment in a bag, a pant or a jacket. Alternatively, a waist band of a pair of trousers or a headband of a hat would provide a similar enclosed space into which the cord 22 can be inserted, and the space is unobstructive, and can keep the cord 22 safe for emergency situations (FIGS. 10, 11, 12 and 13). In addition, one end of the insert or frame 28 may be molded to form a whistle 26, as depicted in FIG. 10.

The inner core 12 can be accessed through the opening 32 at one end of the sheath 30. Alternatively, in the case of a larger application like a waist belt or a shoulder strap, a pocket can be sewn on the strap, or a cavity made in the body of the strap to receive the inner core 12 wrapped with the cordage 22. This might be accessed by a zipper, Velcro® closure or some other appropriate closure means.

The inner core 12 can be constructed in a number of ways. In some embodiments, as shown in FIGS. 2A and 2B, the inner core 12 may serve as a central "frame" element around which the cord 22 can be tightly wound. This arrangement makes the wound cord 22, which is normally very flexible and impossible to maintain a shape, into an item that is neatly organized and has enough rigidity to be inserted between the two sheath layers 301, 302 of the sheath 30 of the device 10 without the need of additional tools or skill Due to this arrangement, the inner core 12 can be removed and reinserted multiple times, depending on a user's needs.

The result is a flat strap for storing a significant amount of cordage of one or more types. Due to this approach, the cord 22 can be inserted easily into straps, belts, gun slings, etc., and panels of bags and clothing, making this an easy and convenient means for storing cord that takes little space, and can be utilized in case it is required in an emergency situation. Some embodiments of this approach may include belt, shoulder strap, strap of a back pack, gun sling, or other straps of similar use (FIGS. 10, 11, 12 and 13).

Figure 12:
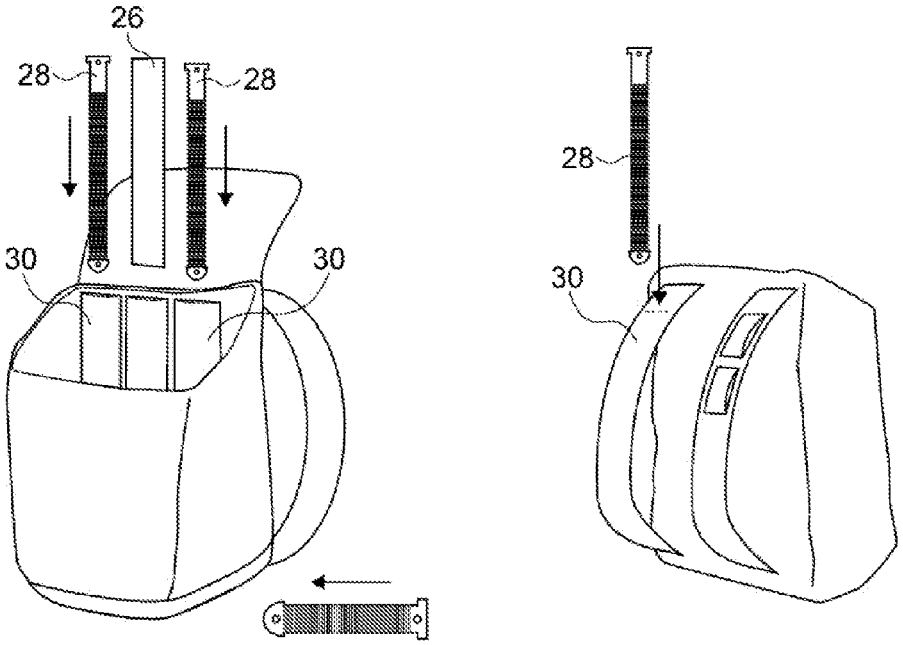
FIG. 12 shows how the frame and cord approach can be used in the inner seams of a backpack or into the straps of a backpack.
Figure 13:
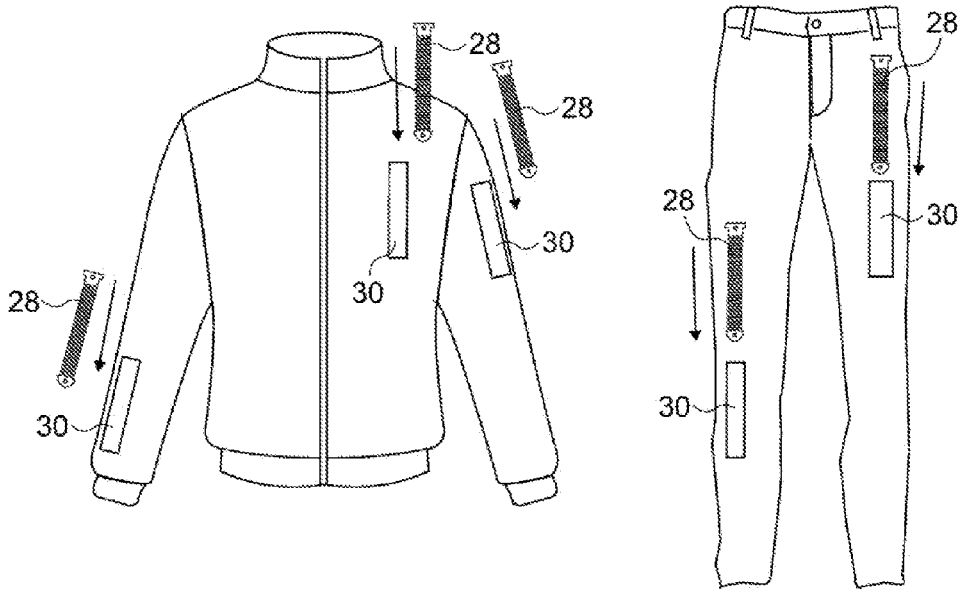
FIG. 13 shows how this means for storing cordage could be used in items of clothing.

Another embodiment would be to make the frame 28 longer and broader. This can allow more cordage 22 to be stored and the inner core 12 may then be inserted into the lining of a backpack, or a specially designed pocket in the pack or an item of clothing, such as a waistband of a pair of trousers, or a sewn pocket in a jacket for convenient and safe storage (FIGS. 12 and 13).

The cord 22 can be of one or more types, and cords of different sizes (diameter) and weights can be wrapped around the inner core 12 to offer greater options in an emergency situation. For example, a stronger cord 22 can be combined with a lighter fishing line 24 to offer more options to the user, as shown in FIG. 2A. In some embodiments, one cord can be wrapped on top of another cord that is wrapped around the inner core 12. In some embodiments, one part of the inner core 12 carries one type of cord, while another part of the inner core 12 carries a different type of cord. In this way, users can select the type of cord they require without unraveling one cord to access the other cord. This selection of cords is impossible with existing paracord bracelets or straps. Furthermore, depending on the environment in which the users are likely to find themselves, the inner core 12 can be more adapted to meet the needs of that environment. For example, a stronger fishing line for sea fishing and a lighter fishing line for freshwater environments.

The insert or frame 28 may be made of plastic sheet, aluminum foil, waterproof paper, or other materials that can perform the function intended. In the case of being made from waterproof paper, the inner core 12 can be a multifold waterproof paper designated by reference numeral 29 in the cross sectional view shown in FIG. 2B. The multifold waterproof paper 29, when unraveled, can provide survival instructions. The sheath 30 may be made of fabric, leather, plastic, or any other suitable material.

In the case of a larger core being used, for example, for the purpose of inserting into a waist belt, or a larger version being inserted into the lining of a backpack, a folded emergency blanket, designated by reference numeral 29' in the cross sectional view shown in FIG. 2B, could be used to form the inner core 12 around which the cordage 22 is wrapped. These are just some examples of how this device might be used.

In a further embodiment, a small packet may also be placed flat against the inner core 12 in which small survival items can be stored. Examples of small survival items may include fishing hooks, fishing line weights, etc. This packet can be taped to the outside of the wrapped cord, or underneath the wrapped cord.

The end result is a neatly bound item that can slip easily into the sheath 30 of a watch strap, belt, shoulder strap, backpack strap, waistband etc for safe keeping. This also offers an organized means for storing the cordage, allowing removal of only what is needed in an emergency situation and saving time.

In some embodiments, useful survival items can also be incorporated inside the sheath 30. These survival materials may include a length of natural fiber twine (for use as tinder), metal wire for traps and snares, and other items suitable for survival purposes.

These items can be wrapped in a similar manner as the cord 22 around the inner core 12, or run around the inside of the sheath 30 between the inner core 12 and the inner surface of the sheath 30.

Figure 11:
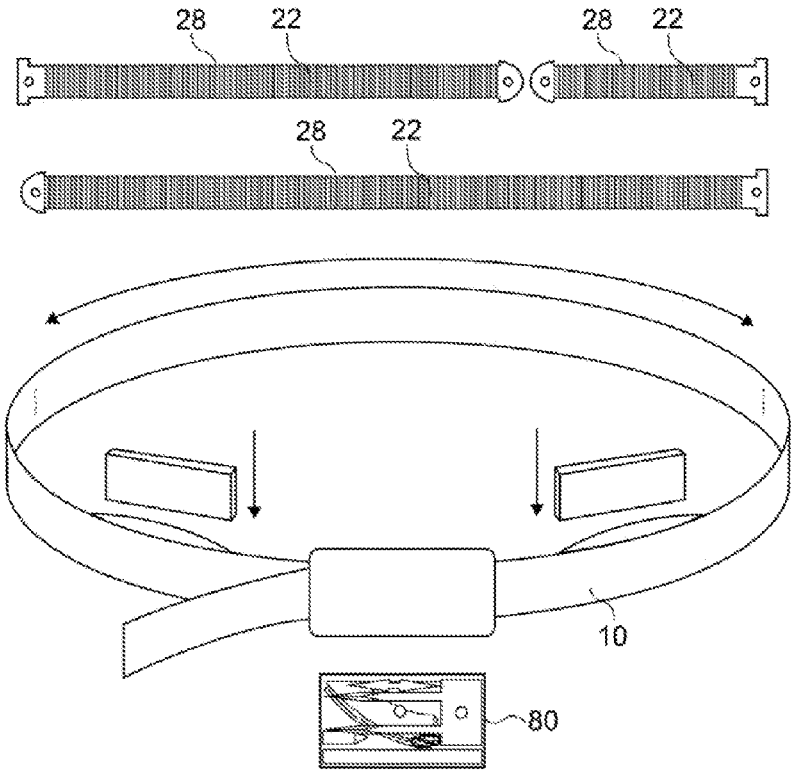
FIG. 11 shows an embodiment of the present application used as a belt with the survival tools hidden in pockets, or integrated into a buckle.

The approach needs not be restricted to using only one inner core 12. As shown in FIGS. 4A and 11-13, in some embodiments of the present application, more than one inner core 12 can be inserted into the sheath 30 of a strap or belt. In some embodiments, a separating means, such as stitching 31, may be provided in the sheath 30 to separate two inner cores 12 inserted inside the sheath 30. This way, cordage of different weights can be further separated and even color coded or tagged, so that in an emergency situation the user can quickly assess which cordage will be better used for the situation at hand. Alternatively, two inner cores 12 could be used in parallel. They need not be of the same length as they could be used to store different types of cordage, which may require more or less space (FIG. 11).

Figure 5:
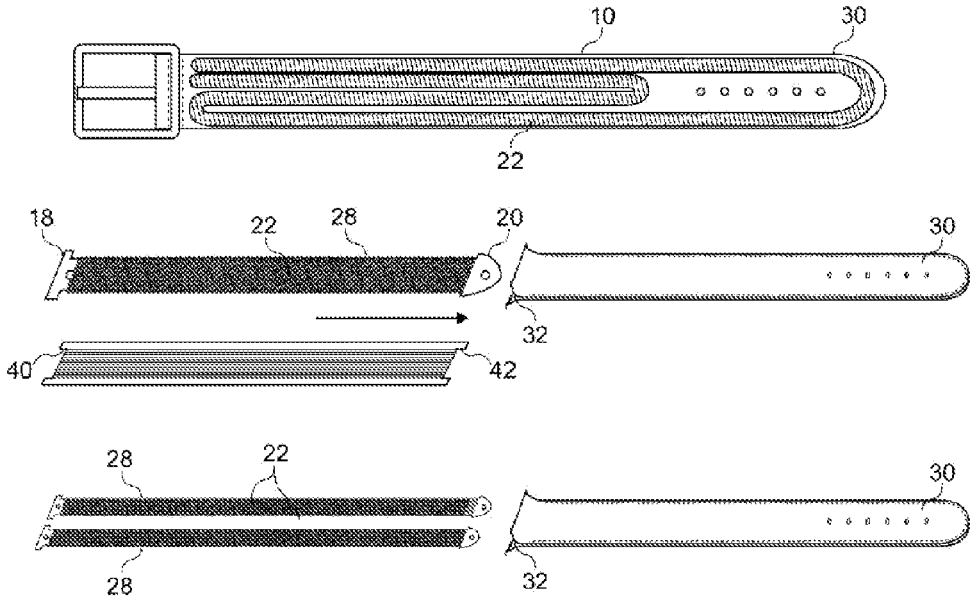
FIG. 5 shows how one or more inner cores slide into a sheath of the strap with a buckle-and-hole arrangement according to some embodiments of the present application.

Due to the size and overall length of a watch strap, the device 10 needs to be used in storing additional cord as much as possible. When considering longer straps and belts, such as waist belts or gun straps or bag straps, the inner cores 12 can be inserted into the sheath 30 with a traditional buckle-and-hole structure, as shown in FIG. 5, and still be able to carry a substantial amount of cord.

Figure 7:
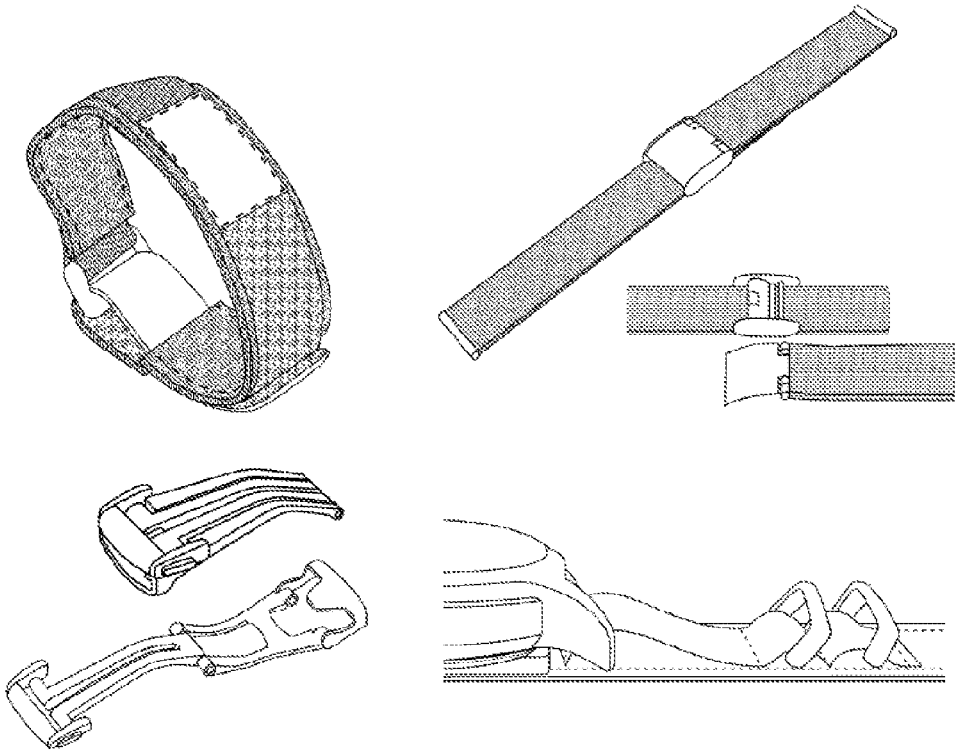
FIG. 7 shows suitable buckle arrangements for the strap according to some embodiments of the present application.

Referring to FIGS. 4A and 4B, the buckle used will be the type that can grip an end of the strap, so that no holes are required, allowing the inner core 12 to run the entire length of the strap. Some examples of such buckle structures can be seen in FIG. 7.

Alternatively, as shown in FIG. 3, a traditional watch strap/belt buckle can be adopted, in which a series of eyelets at one end of the strap and a buckle-and-tongue structure at the other end of the strap 10.

FIGS. 6A-6E show some embodiments of the device 10 for carrying cordage and survival items. The outer sheath 30 of the device 10 may have a length sufficient to form into a watch strap 60 for carrying thereon a watch case 62, and a box 80 for carrying survival tools and other items, which can be held underneath the watch case 62.

Figure 6A:
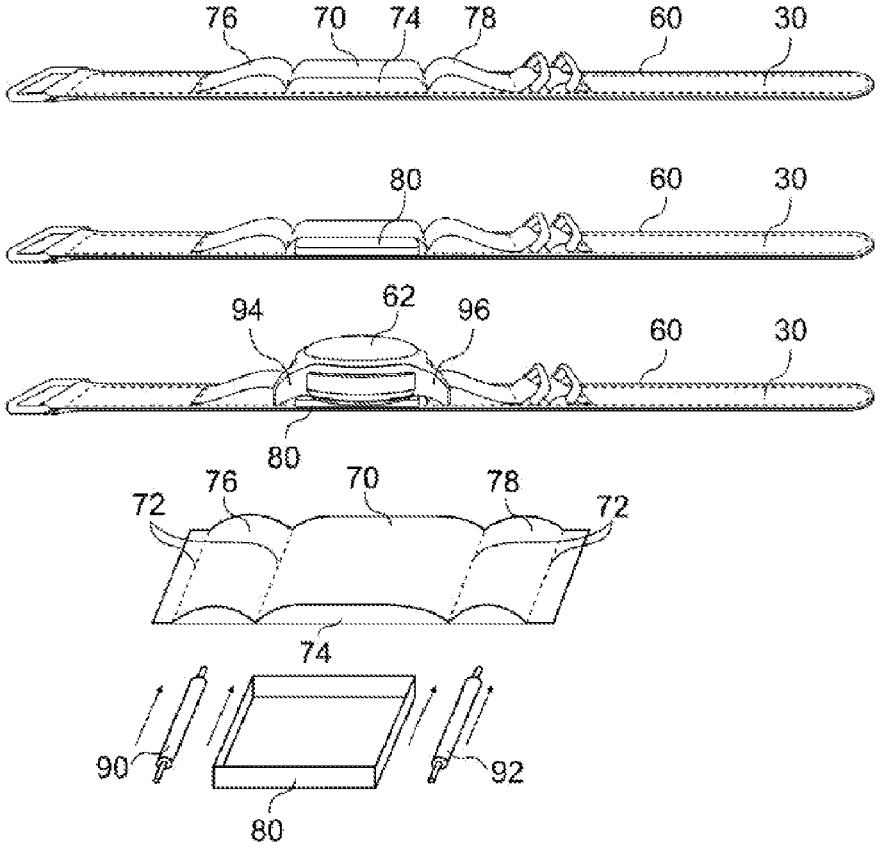
FIGS. 6A-6E show how a survival tool box and two watch spring bars are accommodated into the loops of the strap according to some embodiments of the present application.
Figure 6B:
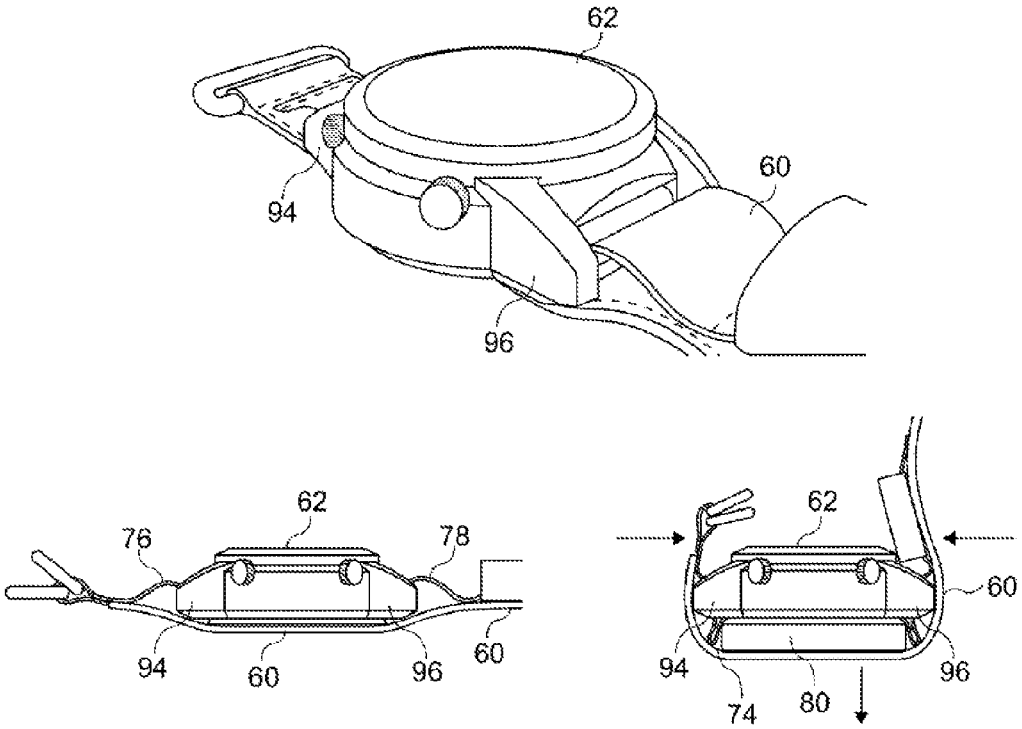

FIGS. 6A and 6B show a watch strap 60 which may further include a strip 70 attached on one side of the sheath 30 at a central portion thereof by four longitudinally spaced apart and transversely extending stitches 72, thereby forming a central loop 74 defining a transverse bore dimensioned to accommodate therein the survival tool box 80, and two additional loops 76, 78 defining two additional transverse bores disposed at two opposite closed ends of the central loop 74 and dimensioned to accommodate therein two bars/pins such as attachment bars, fixing pins, or spring bars 90, 92 on which two opposite lug portions 94, 96 of the watch case 62 can be mounted respectively. The strip 70 may be rectangular in shape, and may be made of fabric, leather, plastic, or any other suitable material.

In the case of a watch strap, the series of loops 74, 76, 78 may be positioned and sized to receive the survival tool box 80 and the two spring bars 90, 92 or securing pins of the watch case 62. The loops 74, 76, 78 may be positioned to place the survival tool box 80 underneath the watch case 62.

In the case of a long belt or strap, loops, pockets or a pouch can be of different sizes in order to accommodate different survival tools, such as a modular knife, a compass, sewing kit, fishing kit, etc. (FIG. 11). Depending on the application, the loops 74, 76, 78 could be replaced by a pouch or a stitched pocket to hold the survival tools.

The survival tool box 80 may be placed onto the watch strap 60 by the provision of sewing the strip 70 on the top sheath layer 301 of the sheath 30, as shown in FIG. 1. In the case of a watch strap, the survival toll box 80 may be placed underneath the watch case 62. Such an arrangement allows the survival tool box 80 to fit and flush underneath the watch case 62, keeping the survival toll box 80 neatly stored and less obvious. To release the survival tool box 80, a user can lift the ends of the watch strap 60 up from both sides of the watch case 62 so that the central loop 74 carrying the survival tool box 80 moves downwards to a position offset from the watch case 62, as shown in FIG. 2B. The survival tool box 80 can then be removed from the central loop 74 of the watch strap 60.

Figure 6C:
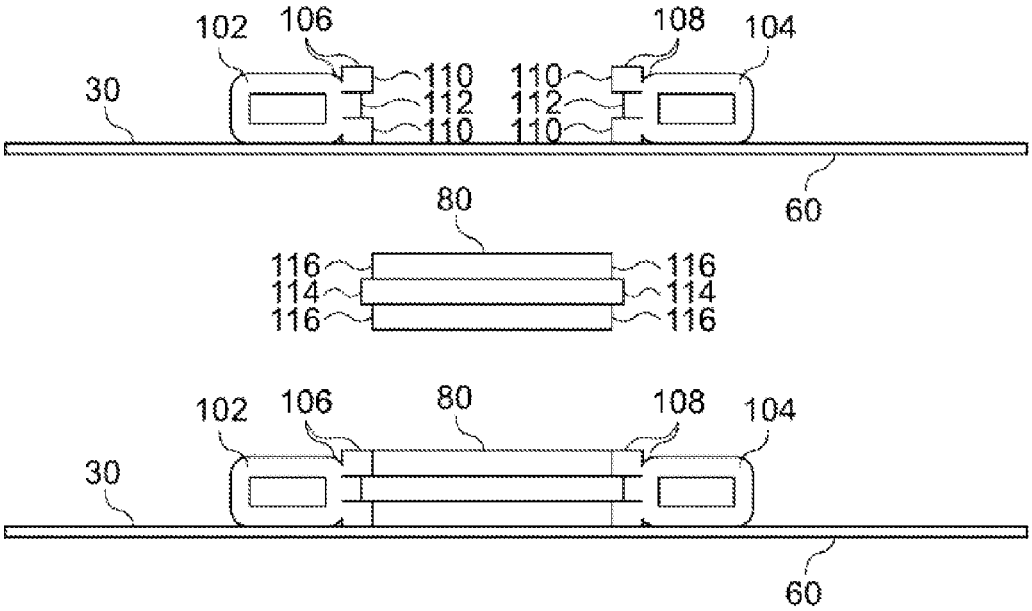

FIG. 6C shows a watch strap 60 which may further include two longitudinally spaced apart transverse sleeves or tubes 102, 104 attached on one side of the sheath 30 at a central portion thereof, and dimensioned to accommodate therein two spring bars 90, 92 on which two opposite lug portions 94, 96 of the watch case 62 are mounted respectively. Two oppositely facing sides of the two tubes 102, 104 may be respectively provided with two oppositely facing transverse sidewalls 106, 108 formed with transversely extending and oppositely facing projections 110 and recesses 112 slidably engageable with complementary projections 114 and recesses 116 formed on two opposite sides of the survival tool box 80. The survival tool box 80 can be disposed underneath the watch case 62 and slid in and out of the watch strap 60 from the 3 o'clock or 9 o'clock position of the watch. The tubes 102, 104 may be made of plastic, silicone, or any other suitable material.

Figure 6D:
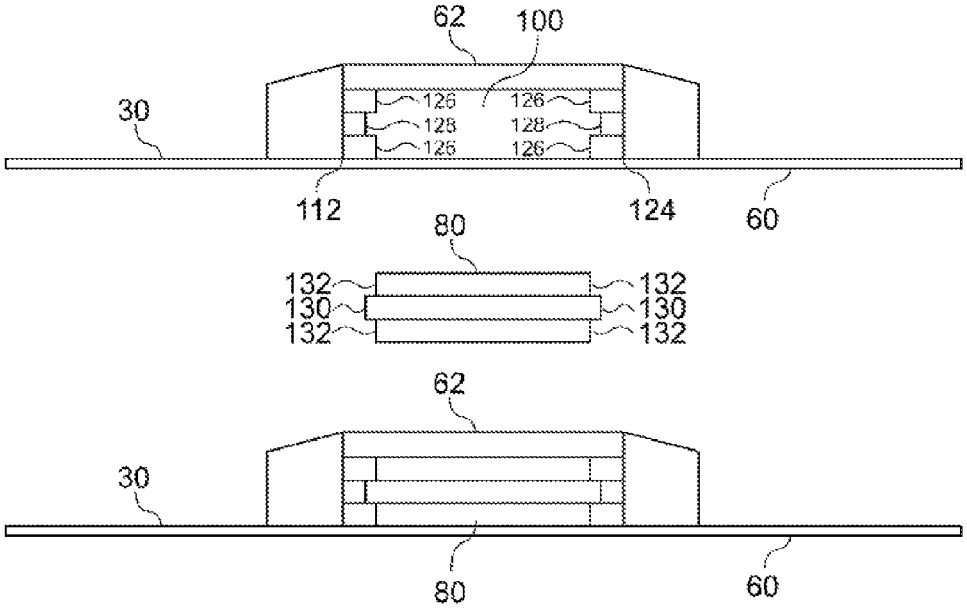

FIG. 6D shows the watch case 62 formed with a transverse bottom channel 100 having two oppositely facing transverse sidewalls 122, 124 formed with transversely extending and oppositely facing projections 126 and recesses 128 slidably engageable with complementary projections 130 and recesses 132 formed on two opposite sides of the survival tool box 80. The survival tool box 80 can be disposed underneath the watch case 62 and slid in and out of the watch strap 60 from the 3 o'clock or 9 o'clock position of the watch.

Figure 6E:
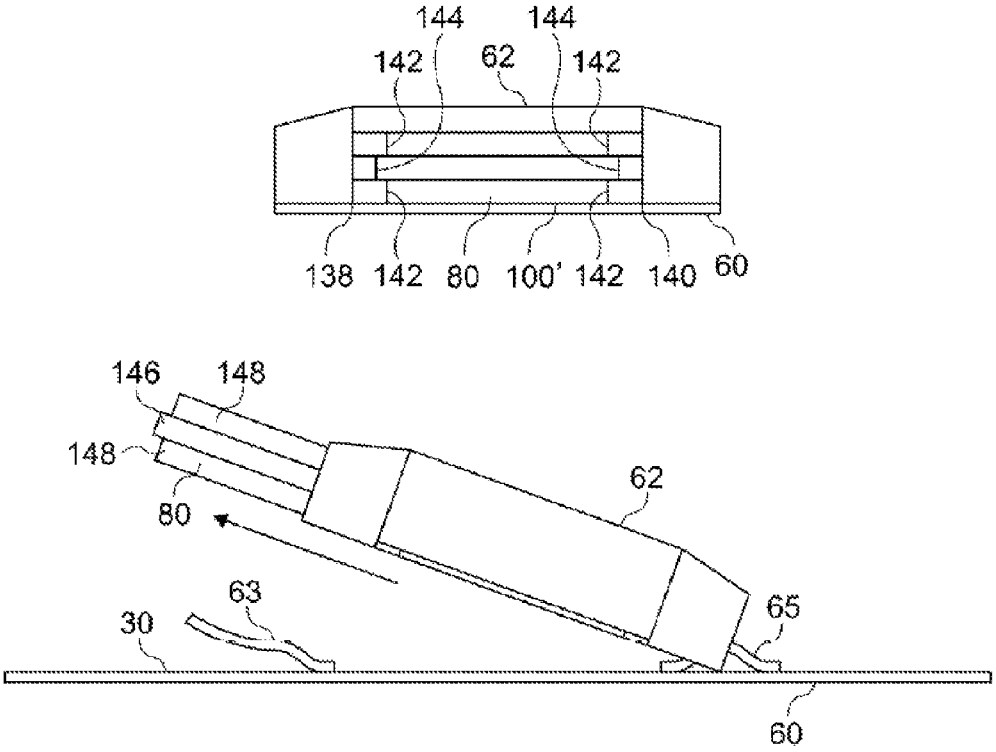

FIG. 6E shows the watch case 62 formed with a longitudinal bottom channel 100' having two oppositely facing longitudinal sidewalls 138, 140 formed with longitudinally extending and oppositely facing projections 142 and recesses 144 slidably engageable with complementary projections 146 and recesses 148 formed on two opposite sides of the survival tool box 80. The survival tool box 80 can be disposed underneath the watch case 62 and slid in and out of the watch strap 60 from the 12 o'clock or 6 o'clock position of the watch by releasing one of the two quick release loops 63, 65 attached on the watch strap 60 for looping around the two spring bars/fixing pins, quick release bars 94, 96 on the watch case 62.

Figure 8A:
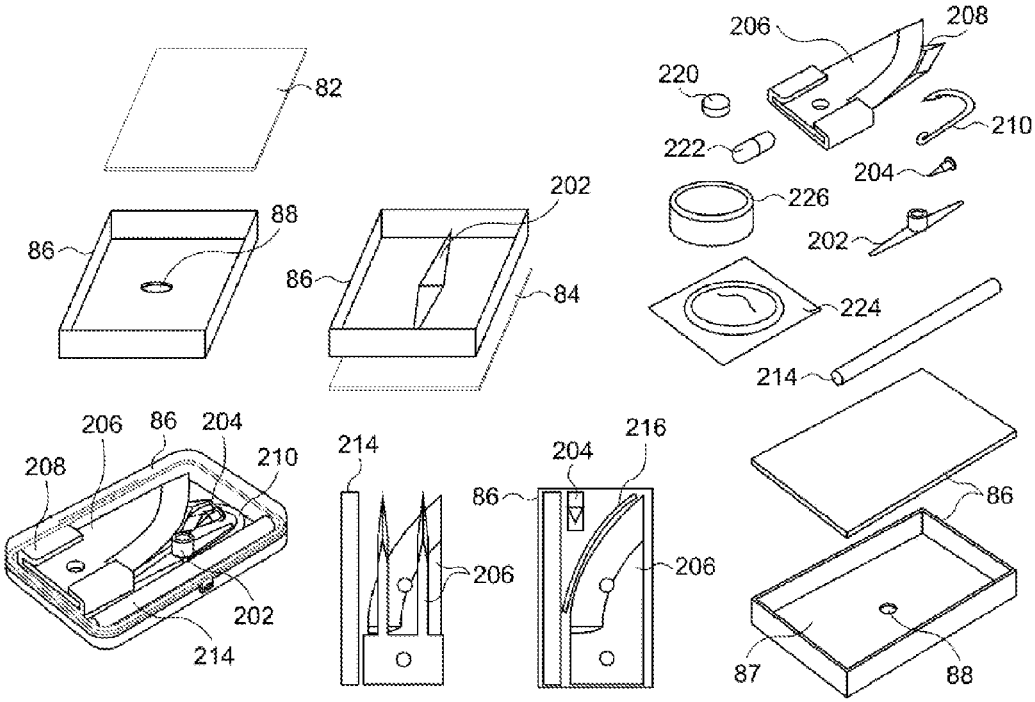
FIGS. 8A, 8B and 8C show a survival tool kit stored between the loops on the strap according to some embodiments of the present application.
Figure 8B:
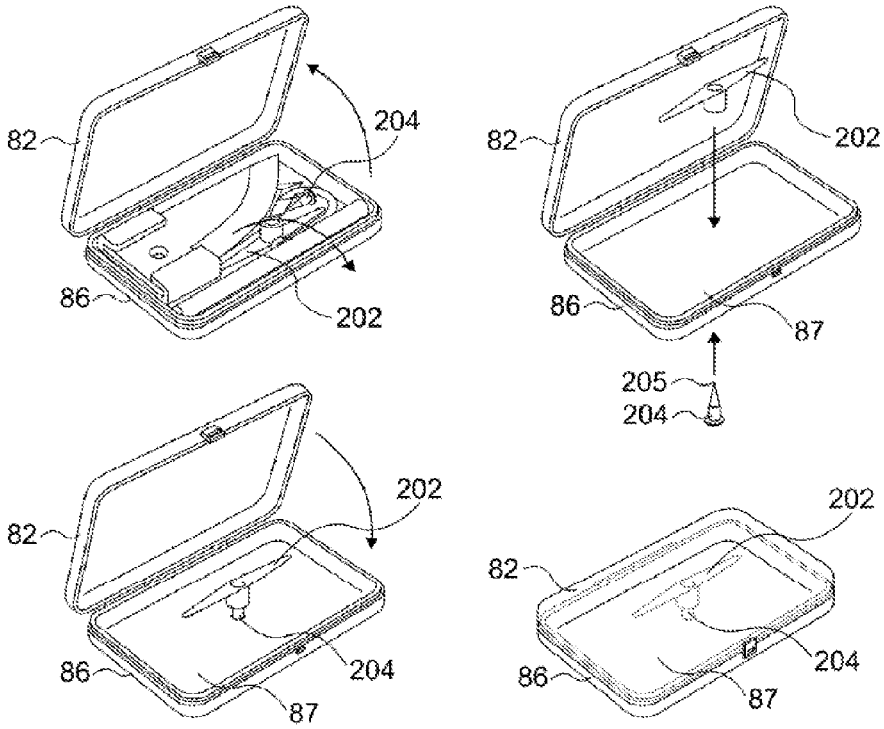
Figure 8C:
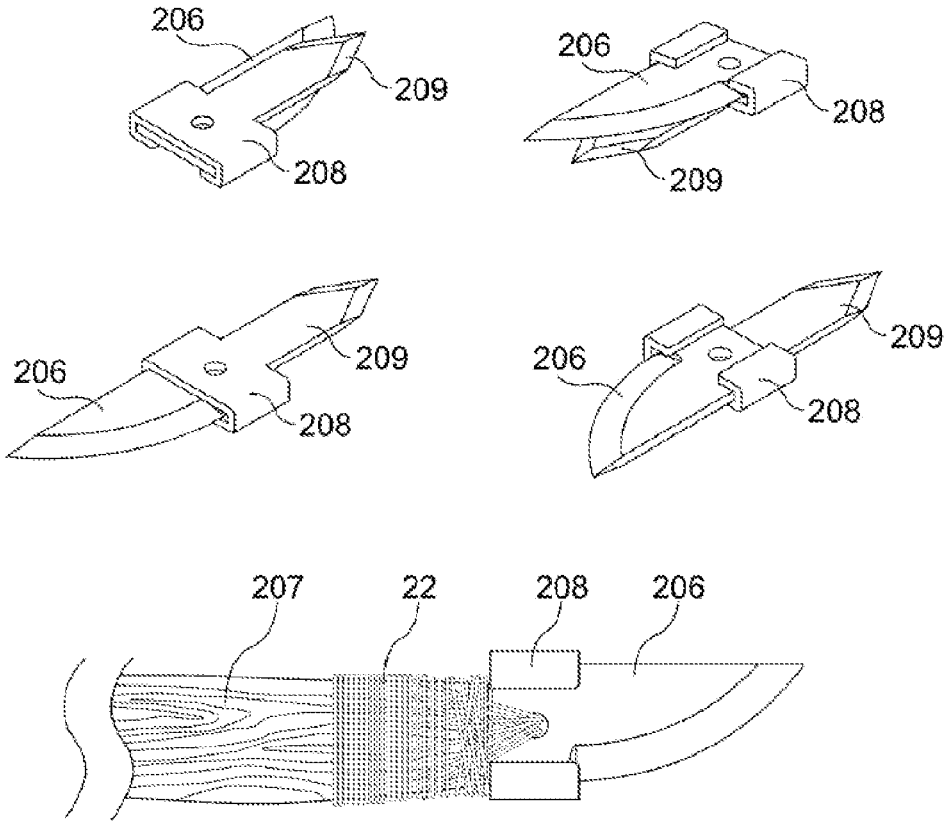

FIGS. 8A, 8B and 8C show a survival tool kit being stored inside the survival tool box 80 according to some embodiments of the present application. The survival tool box 80 may include one or more of the following survival tools:

1. A tray 86 or shaped holder with or without a closing lid for holding other items in place;

2. A Ferro cerium rod 214 for fire-starting;

3. A knife blade 206 and knife blade holder 208. The blade 206 can be packed in a compact manner and in two parts without the inclusion of a handle;

a. The handle can be made from a stick 207 (FIG. 8B) or other suitable item. This can be done by pushing a spike 209 provided on the blade holder 208 into the stick 207. The blade 206 may be placed in the holder 208 and then lashed into place using the cordage 22 to form a modular knife;

b. The back of the knife blade 206 can be used as a striker for the Ferro cerium rod 214;

4. A modular compass which may include a compass needle 202 and a compass pivot pin 204. The pivot pin 204 may be mounted on and extending inwardly from an inner surface of a bottom wall 87 of the box 80, and terminating in a sharp end 205. The compass needle 202 may be placed on top of the sharp end 205 of the pivot pin 204 to form a compass. The tray 86 may then become a base of the compass. A notch, indentation or slot may be formed on the inner surface of the bottom wall 87 of the box 80 to facilitate the mounting of the pivot pin 204 thereon. Alternatively, the pivot pin 204 can be inserted through a hole 88 formed on a bottom wall 87 of the tray 86 (FIG. 8), or pushed through the bottom wall 87 of the tray 86 (FIG. 8A) as the pivot pin 204 has a sharp end 205 sharp enough to pierce through the tray 86, and then the compass needle 202 can be placed on top of the sharp end 205 of the pivot pin 204 to provide a working compass;

5. The underside of the compass can be a mirror 84, and the mirror 84 can be used as a signal mirror;

6. Fishing hooks 210 and fishing line weights 211;

7. A lid 82 on the tray 86. The lid 82 may be made of a transparent material, allowing the contents when packed to be safely stored, and when the items are removed from the tray 86, the tray 86 with the lid 82 can hold the compass needle 202 in place to form a working compass. Alternatively, the package could be held together by a heat shrunk item, or vacuum or heat sealed or other such sealing methods so as to keep the tools stored compactly together and away from moisture, dirt etc.; and 8. A water purification tablet 220, medicine/drug 222, a condom 224, and/or a water container/water carrying device 226.

The approach of having such a modular survival tool kit provides a unique benefit. Products on the market today attempt to incorporate finished tool, miniaturize items to meet the purpose, and add to a strap or build into the watch case accordingly. By breaking the tools into a modular approach as described in this application, it allows a number of tools to be packed more efficiently together and save space. It can reduce size, and allow incorporation larger and thus more useful tools than the equivalent paracord solutions when correctly assembled. It is more useful and reliable in an emergency situation and less obstructive in day to day activity when the tools are not required. Other small items of use in a survival situation may also be stored in a similar manner.

Different survival tool kits might be developed and sold for use in different environments. For example, a survival tool kit for use in a desert would be different from one for use in a wet environment. These survival tool kits could be purchased and swapped out depending on where the users are going or might expect to find themselves.

In the case using the device 10 of the present application as a watch strap, it is intended that the watch strap is able to be used with a multitude of watch cases from different manufacturers. So long as the watch case 62 is large enough from lug to lug to fit the spring bars 90, 92 into the corresponding loops 76, 78, as shown in FIG. 6A, the strap device 10 is usable with most watches.

Figure 9A:
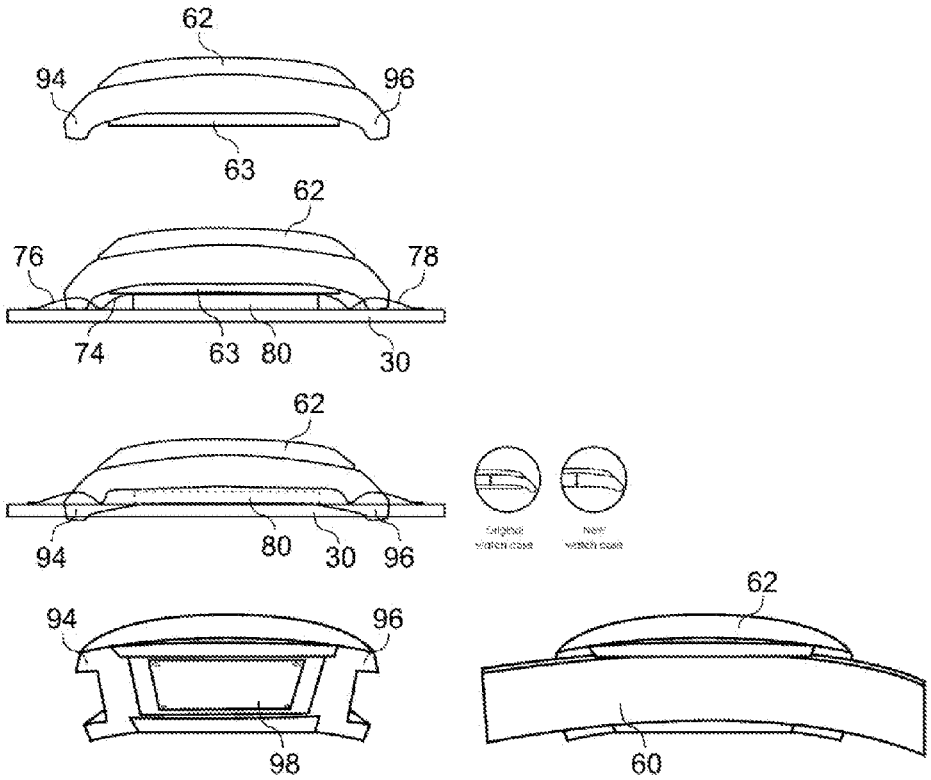
FIG. 9A shows watch cases according to some embodiments of the present application.
Figure 9B:
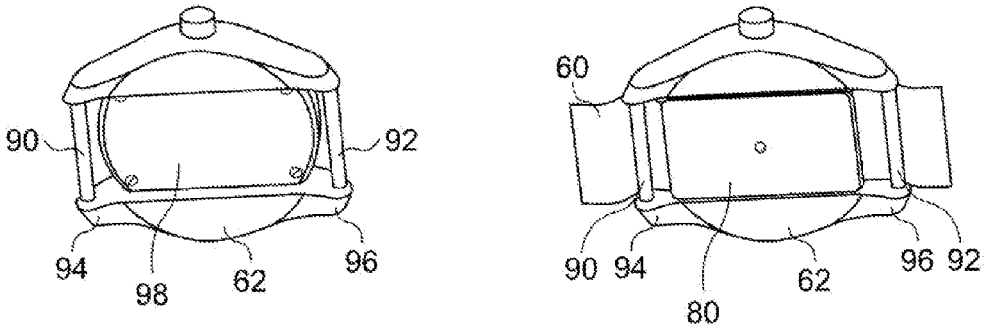
FIG. 9B shows watch cases with a channel according to some embodiments of the present application.

Referring to FIGS. 9A and 9B, it is the trend for watches today to have a screw down case back 63, which helps to make the watch "sit up" on top of the survival tool box 80 placed in the loop 74 and underneath the watch case 62. This is because the screw down case back 63 has a raised edge that is higher than the case back itself, as shown in FIG. 9A.

This could present a higher profile on the wrist, depending on the watch in question. However, a watch case could be developed such that it is not using a screw down case back and other design improvements as detailed in FIGS. 9A and 9B.

In an embodiment of the present application, a flat metal plate can be used that is screwed into place with a gasket to maintain water resistance. In another embodiment, the watch case may be constructed in such a way so as to have the movement and dial assembly placed into the watch from the top, then secured into place with a bezel that is secured with a gasket and screws. Either way, the back of the watch offers a flat surface to sit against the survival tool box 80 on the device 10.

Because this watch case is specifically designed to be used with the survival tool box 80 and strap arrangement, the lugs can be angled and lowered slightly to accommodate the increased height over the strap provided by the survival tool box 80. An illustration of the same can be found in FIGS. 9A and 9B.

Furthermore, the sides of the watch case 62 can also be lowered to provide a bottom recess 98 within which the survival tool box 80 may sit. The survival tool box 80 can still be accessed by pushing the strap down slightly and letting the survival tool box 80 slide out of its loop/housing. This arrangement has a lot of benefits. First of all, the survival tool box 80 can be held more securely by the strap/loop structure as it is held in place by the lower side of the watch case 62 and strap when being worn on a wrist of a user. Secondly, the appearance of the watch will look better, hiding the survival tool box 80 from view and making the watch design appear more uninterrupted as it rests on a user's wrist. Thirdly, it is possible nowadays to use slim watch movements, so this arrangement can still provide a watch that is around 15 mm or less in height, including the survival tool box 80 hidden under the watch case 62. Finally, this arrangement is an improvement over the prior art in which watch cases are designed in such a way as to have a hatch or lid opening, or items slide out, or a layered approach where, for example, a compass and a watch are combined, all of which require a construction for the watch case to have multiple layers and elements and greatly add to the construction and the overall height of the watch, making them less appealing.

The present application also relates to a method for mass production of the device 10 for carrying cordage and survival tools disclosed above. In one embodiment, the method may include the steps of (a) providing a top layer of material 301; (b) providing a bottom layer of material 302; (c) stitching the top and bottom layers of material together using a sewing machine to form a sheath 30 with an opening 32; (d) providing an inner core 12 with survival instructions imprinted thereon; (e) wrapping a cordage 22 around the inner core 12 using a jig; and (f) inserting the inner core 12 with the cordage 22 wrapped thereon into the sheath 30 through the opening 32 to form the strap device 10.

In another embodiment, the method may include the steps of (a) providing an inner core 12; (b) wrapping a cordage 22 around the inner core 12 in a first direction using a jig; (c) wrapping the cordage 22 around itself in a second direction perpendicular to the first direction using the jig thereby forming a rope-like cordage 50; (d) inserting the rope-like cordage 50 into a heat-shrinkable tube 52; (e) applying heat to heat shrink the tube 52; and (f) stitching the heat-shrinked rope-like cordage 50 to a strap device 10.

Figure 14:
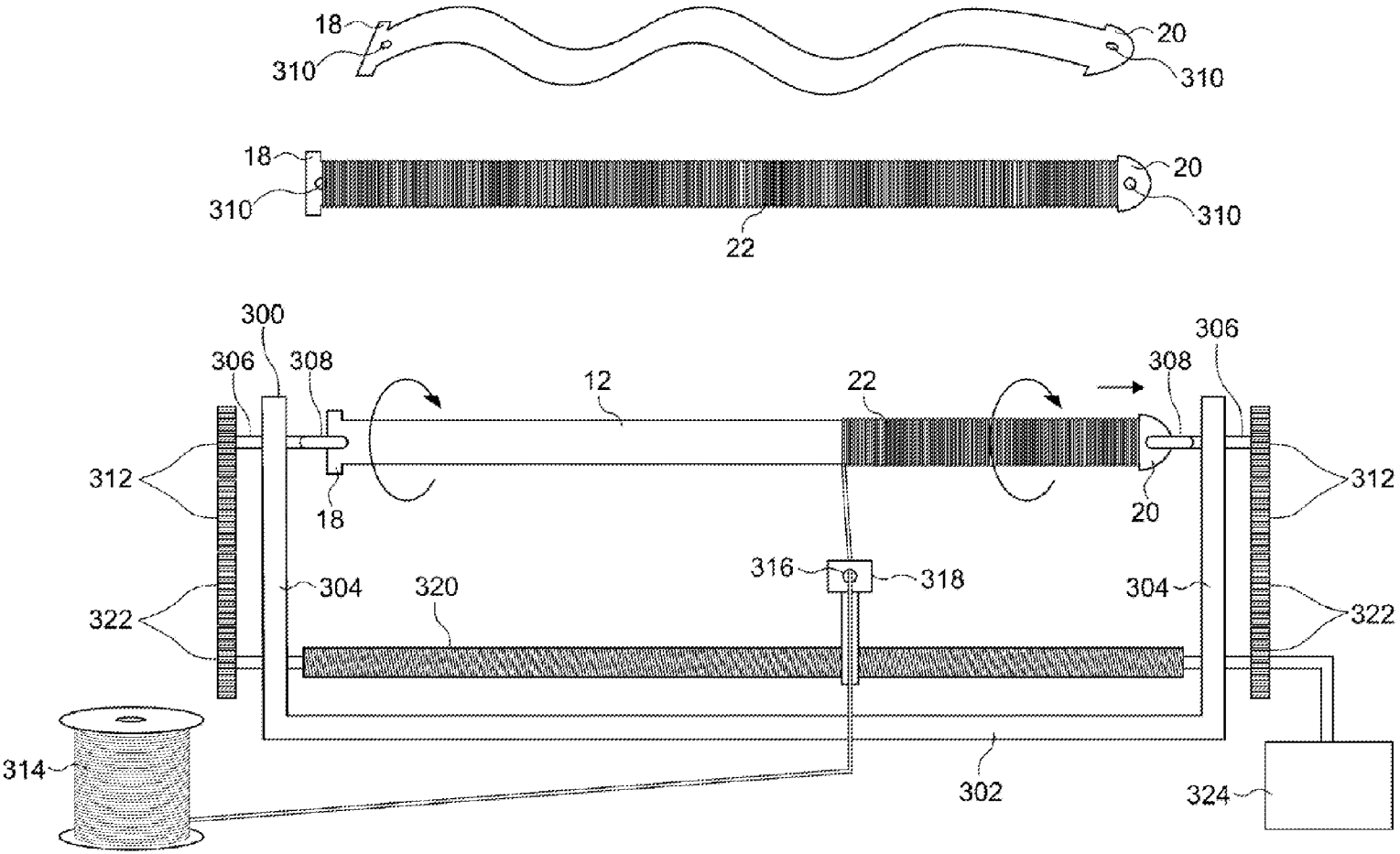
FIG. 14 shows an embodiment of a cord-winding machine of the present application.

The step of wrapping cordage 22 around the inner core 12 is a manufacturing step of the present application. Cordage 22 may be wound around the inner core 12, as depicted in FIG. 14. However, it is understood that:

A. the cordage 22 must be evenly wound around the inner core 12 turn after turn so as to avoid overlapping turns or forming unnecessary spacing between turns. If the turns are overlapping, then the finished article will become too thick and bulky. If unnecessary spacing is formed between turns, then the cordage may easily become loosened.

B. The inner core 12 is flexible in nature, and therefore it needs to be held with enough pulling force along its longitudinal axis such that the inner core 12 can be held tightly. Once the inner core 12 is taut, the inner core 12 has a rigidity that allows the cord 22 to be wound around it.

FIG. 14 shows an embodiment of a cord-winding machine for the manufacturing of the device for carrying cordage and survival tools of the present application. The method may include the steps of (i) providing a flexible and elongate inner core 12 having two opposite longitudinal sides 14, 16 and two opposite ends 18, 20; (ii) holding the two opposite ends 18, 20 of the inner core 12 on a jig 300, and pulling the two opposite ends 18, 20 of the inner core 12 longitudinally in opposite directions such that the inner core 12 becomes taut and rigid; and (iii) winding a cord 22 around the inner core 12.

The jig 300 may include a base 302 and two spaced apart vertical posts 304 extending upwards from the base 302. Two rods 306 may be supported horizontally at an upper portion of the two vertical posts 304 respectively. Two inner ends of the two rods 306 may be formed with two hooks 308 for hooking to the two opposite ends 18, 20 of the inner core 12 through two holes 310 formed thereon respectively. The two hooks 308 can apply a sufficient pulling force on the two opposite ends 18, 20 of the inner core 12 along its longitudinal direction, as shown by an arrow, such that the inner core 12 can be held tightly. Once the inner core 12 is taut, it possesses a rigidity that allows the cord 22 to be wound around it. Two outer ends of the two rods 306 may be provided with two sets of upper gears 312 respectively.

The cord 22 can be fed from a spool 314 and passed through an aperture 316 of a feeder 318. The feeder 318 can be threadably coupled with a screw thread 320. Two opposite ends of the screw thread 320 may be supported at a lower portion of the two vertical posts 304 respectively such that the screw thread 320 can be disposed horizontally and parallel to the inner core 12. Two outer ends of the screw thread 320 may be provided with two sets of lower gears 322, which can be meshed with the two sets of upper gears 312 respectively.

A motor 324 can be used to drive the screw thread 320 to rotate. As the screw thread 320 rotates, the inner core 12 spins simultaneously in a direction as shown by the two arrows, and the feeder 318 moves in one direction along the length of the screw thread 320 (and back again), thereby winding the cord 22 around the inner core 12.

The cordage and survival tool carrying devices of the prior art have the following drawbacks.

1. One Size does not Fit all:

To make a paracord bracelet, a predetermined length of paracord or other cordage is used and selected based on the intended wearer's wrist size, then hand-woven to the appropriate length to fit their wrists. Because the cord or rope used has typical high-strength, it is not designed to stretch any significant amount. The additional strength added by weaving also increases resistance to stretching. As such, the length of the paracord and the size of the article produced from the paracord (in this case a watch strap or bracelet) must be perfectly sized to fit the individual wearing it. As a result, a person with a smaller wrist will have less cord to use than a person with a larger wrist. There is also limited adjustability in the size once the strap is made. Steel shackles are often used, but the adjustment is restricted to the number of holes available (usually 3) or around 1.5 cm.

Therefore, a one-size-fits-all approach (as often taken with more general use of watch straps and belts) is not possible. With regular apparel such as shoes and shirts, this is unavoidable for the retailer. But for watch retailers looking to sell a finished watch, finished watch strap, belt or strap, they do not normally have an interest in stocking multiple sizes of strap to accommodate the customers' needs.

It is suggested that one of the main reasons woven paracord watch straps and belts have not become more popular in retail due to the difficulties of one size fitting all people. Attempts to remedy this have been made, especially in the survival bracelet category, which includes a draw string arrangement. However, such arrangement does not utilize the full size of a person's wrist, thus limiting the amount of cord found in the strap or bracelet to the smallest possible size. This solution is fully adjustable.

2. One Use Purpose:

Once the paracord watch strap or belt is unraveled, it no longer serves as a watch strap or belt, unless the user wishes to reweave a strap or belt. This is made more difficult if less cordage is available due to some having been used for another purpose. Reweaving is cumbersome and time consuming, and arguably requires the knowledge for reweaving a strap/belt from scratch. It is not ideal in an emergency situation.

3. Amount of Available Cord Restricted to Wrist Size:

Due to the nature of paracord being hand-woven and not stretchable, this solution is restrictive and can only offer an amount of paracord to a length dictated by the customer's wrist size.

4. Not a Continuous Length of Cord:

The cord in a paracord bracelet is not one continuous piece of cord. It is around 10 feet long with the inner yarns also being the same length. If a user requires a longer continuous piece of cord, then the user will need to strip out the individual yarns and tie them together.

5. Difficulty Removing Individual Yarns and their Type/Weight:

Paracord is a kern mantle style rope. As a result, it is very difficult to remove only one yarn from the main body (kern) of the cord. Therefore, once one yarn is removed, a user is likely required to remove all other yarns. How this is then kept in a safe and neat manner for further use presents a problem.

Traditionally, paracord is made from 7 strands of cord all of the same strength. For paracord 550, the popular choice for such applications, each strand of cord has a breaking strain of 70 lbs. Therefore the users of paracord bracelets, watch straps and the like, have limited options in the weight/strength of the cord inside the paracord. Some applications on the market today weave fishing line and other cordage of different weights into the paracord strap. In one known execution, a paracord strand is treated and coated in a flammable material, offering a source of tinder into the paracord. However, whether it is fishing line or tinder added into the paracord strands, or the weave of the paracord bracelet/strap/belt and the likes, the item must be unraveled completely in order to access the specific cords, fishing line etc.

6. Issues Accessing Specific Tools "Hidden" Inside Weave:

It requires a strap or bracelet to be unraveled to release all the items/tools hidden inside the cord. This can be time consuming, time often being precious in an emergency situation. It is not always required to release all items, rather a single item, for example, a fishing hook or needle.

This also creates a problem when wishing to wear the bracelet on an airplane as any knife blades or other non-airline approved items hidden inside the strap cannot be removed without unraveling the entire strap. Therefore, the entire strap needs to be unraveled and/or checked in.

7. Reduced Size and Usability of "Hidden" Tools:

Due to the nature of the woven paracord bracelet, items hidden in the paracord survival straps often need to be small and/or flexible, so to allow the strap to be bendable and curve around a user's wrist. This in turn reduces the usability of the tools due to their reduced sizes and flexibility. In emergency situations, the reliability of the tools is of utmost concern.

8. Hand Made:

No machines are able to make paracord bracelets at this time. Therefore, the paracord bracelets is hand woven, making mass manufacturing more difficult and expensive, due to the labor intensive process.

9. Bulky Appearance:

Paracord bracelets are often seen as "bulky" items to wear, especially paracord watch straps. The thicker size and bulk, the less attractive to the user over more traditional watch straps. In addition, cordage in general is bulky to carry when woven or wrapped in a regular roll or coil.

10. Cord Damage Via Wear and Tear:

Over time, through wear and tear, paracord bracelets can be damaged, thus providing less use and reliability when required in an emergency situation. It offers a limited life to the bracelets.

11. Custom Made to Fit Specific Watches:

Because paracord is hand woven, the strap needs to allow enough space for the watch case to fit properly. As there are many kinds of watch cases on the market, this means paracord usually needs to be custom-made to fit not only the watch case but also the user's wrist. Also the spacing between the spring bar and the watch body does not always allow enough space for a 4 mm paracord, thus placing the spring bars under pressure when being worn.

The present application provides a means for storing cordage into a one-size-fits-all adjustable strap or belt or the likes designed primarily to carry a usable length of cordage and additional tools to help one survive in an emergency. The strap also allows easy and speedy access to the cordage and survival tools, while retaining its purpose as a strap or belt even once the survival items are in use. This application also allows the user to easily and speedily replace or restore the items after use for safe keeping. The strap has a reduced size/bulk as compared to paracord watch, belt or strap on the market today, thus offering a more attractive and practical alternative. The present application also shows how the same method for neatly and conveniently storing cord into straps and belts can also be extended to other items for use in emergency. Items that will benefit from storing cordage in a space-saving manner using a sheath-like structure/design and using a frame-like insert that adds rigidity to a length of cord and allows it to be inserted into an enclosed space. Jackets, trousers, hats, bags, straps, belts, gun slings and backpacks are some examples. The survival tool kit can also be included in these items as mentioned.

In the present application, a specially designed watch case to better accommodate a modular survival tool kit is described. The device for carrying cordage and survival tools of the present application solves the above-mentioned drawbacks as follows:

1. One Size does Fit all:

The strap/belt of the present application provides a means to hold a significant amount of usable cordage and items useful in a survival situation, while offering a product that is far more adjustable than the current hand woven paracord products available on the market today. This way a watch, a belt or strap can be sold to a customer with the likely outcome that the strap will fit the vast majority of customers, due to its adjustable nature. It provides a one-size-fits-all solution.

2. Retains its Purpose as a Strap/Belt/Bag/Sling/Etc. And Allows Replacement of Items for Safe Keeping:

The present application also allows the strap/belt/bag/sling/etc. to retain their original purposes even after the usable cord and other items have been removed, being more practical and useful in an emergency situation. Furthermore, the cordage and tools can be reinserted into the item for safe keeping or replaced after the event for use for another time without the need to purchase an entire new product. For example, paracord watchstrap once unraveled requires a new paracord watch strap to be purchased to replace it. The present application does not have such requirement.

3. Amount of Available Cordage not Restricted by Users' Size:

Every user will have the same amount of usable cord and will not be restricted to their wrist/belt size. This insert design provides each user with the reassurance that they know exactly how much cordage they will have to use in an emergency.

4. A Continuous Length of Cordage:

The usable cord will be a continuous length, unlike paracord alternatives, which require individual yarns to be removed and tied together. This gives the user an option to conveniently use part or all of the cordage.

5. Easy Removal and Storage of Cordage of Different Weights and Tools:

A required length of cord and any required tools can be quickly and easily removed, reassembled or replaced (in the case of the item being used) back into the strap/sheath for safe keeping in an organized manner. This can be done more conveniently than with the paracord alternatives. Multiple types of cordage and weights of cordage can also be used and accessed easily, without the need of unraveling all cordage to do so. Users may also adopt various cords to meet the environments they are operating in. For example, at sea, a heavier duty fishing line might be required in comparison to a freshwater fishing line.

6. Easy Access to Specific Hidden Tools:

The hidden knife and or tool kit can be removed from the strap, belt, bag, clothing or other item using this approach and placed into checked-in luggage if and when required. In the case of paracord products, knives placed in or integrated into a buckle structure, or woven into a paracord strap make this an impossible task without removing the entire strap or belt, bag or clothing and checking that in.

7. Improved Size and Usability of Hidden Tools:

The hidden tool kit is not required to be bent or flexed around the wrist. By placing the items on the top of the strap (in the case of the watch strap, under the watch case), the ridged strength of the blade and also the length of the fire steel (Ferro rod) are increased, improving overall use. The tool kit takes a modular approach to the knife and the compass, allowing the items to be packed neatly and efficiently. Products on the market today provide a miniaturized version instead, such as small fire steel, small cutting edge and small compass. Smaller items offer reduced usefulness in a survival situation. The modular, multipurpose approach of the tool kit disclosed in the present application is therefore a superior solution.

8. Mass Manufacture Possible:

The products of the present application can be manufactured using equipment such as sewing machines to produce straps, belts, bags, etc. Mechanized jigs can also be used for speedy wrapping of cordage around the insert/frame providing a faster and more efficient manufacturing process than the hand-woven paracord alternatives.

9. Non-Bulky Appearance:

The strap of the present application is less bulky in appearance than the paracord alternatives. The strap or belt of the present application looks like a regular strap or belt, rather than any alternatives on the market today. When applied to other items such as bags or clothing, the strap takes little space, is flat and unobstructive as well as being discreet in appearance.

The watch case design described in the present application accommodates the survival tools in such a manner as to make them less visible and offer the appearance of a normal watch.

10. Cordage Protected by Outer Sheath:

The strap of the present application provides protection to cordage by placing it inside a protective sheath (watch strap, belt, strap, lining of a bag, or specially made pocket in clothing etc.). Adding protection from day to day wear and tear and thus being more reliable in an emergency than the paracord alternatives.

11. One Size Fits Many Watch Cases:

The strap of the present application has the ability to fit a multitude of watch brands.

While the device for carrying cordage and survival tools has been shown and described with particular references to a number of preferred embodiments thereof, it should be noted that various other changes or modifications may be made without departing from the scope of the appended claims.

What is claimed is:

1. A device for carrying cordage and survival tools comprising:

(a) a flexible and elongate inner core having two opposite longitudinal sides and two opposite ends;

(b) a cord wound around the inner core;

(c) an outer sheath comprising top and bottom sheath layers attached together along their edges, and an opening provided at one end of the outer sheath through which the inner core with the cord wound therearound is inserted, the outer sheath having a length sufficient to form into a watch strap for carrying thereon a watch case and a box held underneath the watch case; and (d) a strip attached on one side of the sheath at a central portion thereof by four longitudinally spaced apart and transversely extending stitches, thereby forming a central loop defining a transverse bore dimensioned to accommodate therein the box, and two additional loops defining two additional transverse bores disposed at two opposite closed ends of the central loop and dimensioned to accommodate therein two bars on which two opposite lug portions of the watch case are mounted respectively;

(e) wherein the box carries items selected from the group consisting of a compass needle, a compass pivot pin, a knife blade, a knife blade holder, a fishing hook, a fishing line weight, a fire-starting Ferro cerium rod, a mirror, a water purification tablet, a medicine, a drug, a condom and a water container.

2. A device for carrying cordage and survival tools comprising:

(a) a flexible and elongate inner core having two opposite longitudinal sides and two opposite ends;

(b) a cord wound around the inner core; and (c) an outer sheath comprising top and bottom sheath layers attached together along their edges, and an opening provided at one end of the outer sheath through which the inner core with the cord wound therearound is inserted, wherein the two opposite ends of the inner core are formed with two opposite rectangular notches respectively, and the cord is wound around the two opposite rectangular notches along a transverse direction.

3. The device as claimed in claim 2, wherein a plurality of cords is wound around the inner core, wherein the plurality of cords has different sizes and weights.

4. The device as claimed in claim 2, wherein the inner core is made of plastic, and one end of the inner core is molded into a whistle.

5. The device as claimed in claim 2, wherein the inner core is a multifold waterproof paper that, when unraveled, provides survival instructions.

6. The device as claimed in claim 2, wherein the inner core is a folded blanket.

7. The device as claimed in claim 2, wherein the inner core is made of a material selected from the group consisting of plastic sheet, aluminum foil, and waterproof paper.

8. The device as claimed in claim 2, further comprising a flat packet attached on a surface of the inner core.

9. The device as claimed in claim 2, wherein the cord is wound around the inner core in a first direction, and then wound around itself in a second direction, thereby forming a rope-like structure after the inner core is removed.

10. The device as claimed in claim 9, wherein the rope-like structure is inserted into a tube.

11. The device as claimed in claim 10, wherein the tube is heat-shrinkable.

12. The device as claimed in claim 2, wherein the outer sheath has a length sufficient to form into a watch strap for carrying thereon a watch case, and a box held underneath the watch case.

13. The device as claimed in claim 12, further comprising a strip attached on one side of the sheath at a central portion thereof by four longitudinally spaced apart and transversely extending stitches, thereby forming a central loop defining a transverse bore dimensioned to accommodate therein the box, and two additional loops defining two additional transverse bores disposed at two opposite closed ends of the central loop and dimensioned to accommodate therein two bars on which two opposite lug portions of the watch case are mounted respectively.

14. The device as claimed in claim 12, further comprising two longitudinally spaced apart transverse tubes attached on one side of the sheath at a central portion thereof, and dimensioned to accommodate therein two bars on which two opposite lug portions of the watch case are mounted respectively; wherein the two plastic tubes are respectively provided with two oppositely facing transverse sidewalls formed with transversely extending and oppositely facing projections and recesses slidably engageable with complementary projections and recesses formed on two opposite sides of the box.

15. The device as claimed in claim 12, wherein the watch case is formed with a bottom recess for receiving therein the box.

16. The device as claimed in claim 12, wherein the watch case is formed with a transverse bottom channel having two oppositely facing transverse sidewalls formed with transversely extending and oppositely facing projections and recesses slidably engageable with complementary projections and recesses formed on two opposite sides of the box.

17. The device as claimed in claim 12, wherein the watch case is formed with a longitudinal bottom channel having two oppositely facing longitudinal sidewalls formed with longitudinally extending and oppositely facing projections and recess slidably engageable with complementary projections and recesses formed on two opposite sides of the box.

18. The device as claimed in claim 12, wherein the box carries items selected from the group consisting of a compass needle, a compass pivot pin, a knife blade, a knife blade holder, a fishing hook, a fishing line weight, a fire-starting Ferro cerium rod, a mirror, a water purification tablet, a medicine, a drug, a condom and a water carrying device.

19. The device as claimed in claim 12, wherein the box carries a modular knife comprising a knife blade and a knife blade holder, the knife blade being adapted to be held in the knife blade holder at one end thereof, and another end of the knife blade holder being provided with a spike for insertion into an end of a stick which serves as a handle.

20. The device as claimed in claim 12, wherein the box carries a modular compass comprising a compass needle and a compass pivot pin, wherein the pivot pin is capable of being mounted on or pierced through a bottom wall of the box, and extending inwardly from an inner surface of the bottom wall of the box and terminating in a sharp end, and wherein the compass needle is capable of being placed on top of the sharp end of the pivot pin to form a compass.

* * * * *